United States Patent [19]

Yarwood et al.

[11] 4,274,470

[45] Jun. 23, 1981

[54] BOTTOM BLOCKS FOR ELECTROMAGNETIC CASTING

[75] Inventors: John C. Yarwood, Madison; Derek E. Tyler, Cheshire, both of Conn.

[73] Assignee: Olin Corporation, New Haven, Conn.

[21] Appl. No.: 68,313

[22] Filed: Aug. 20, 1979

Related U.S. Application Data

[62] Division of Ser. No. 957,219, Nov. 2, 1978.

[51] Int. Cl.[3] ..... B22D 27/02

[52] U.S. Cl. ..... 164/49; 164/82; 164/425

[58] Field of Search ..... 164/49, 147, 82, 425, 164/445

[56] References Cited

U.S. PATENT DOCUMENTS 3,948,310 4/1976 Deschapelles ..... 164/425

*Primary Examiner*—Robert D. Baldwin
*Assistant Examiner*—K. Y. Lin
*Attorney, Agent, or Firm*—Victor A. DiPalma; Paul Weinstein

[57] ABSTRACT

A bottom block for use in electromagnetic casting of metals wherein the block is constructed of a material having a closely matched electrical resistivity to that of the metal to be cast. The block may be provided with a deeply hollowed out central section so that during startup the end of the down spout supplying molten metal may be positioned a substantial distance below the plane of the top surface of the bottom block.

16 Claims, 2 Drawing Figures

BOTTOM BLOCKS FOR ELECTROMAGNETIC CASTING

This is a division of application Ser. No. 957,219, filed Nov. 2, 1978.

BACKGROUND OF THE INVENTION

This invention relates to an improved process and bottom block for start up of electromagnetic casting runs when the bottom block is introduced into the inductor area to support an initial surge of metal fed to the casting apparatus. The basic electromagnetic casting process has been known and used for many years for continuously or semi-continuously casting metals and alloys.

PRIOR ART STATEMENT

The electromagnetic casting apparatus comprises several parts consisting of a water cooled inductor, a non-magnetic screen, a bottom block, and a manifold for applying cooling water to the ingot. Such an apparatus is exemplified in U.S. Pat. No. 3,467,166 to Getselev et al. Containment of the molten metal is achieved without direct contact between the molten metal and any component of the mold with the exception of the bottom block which is used in the start up and withdrawl of the casting ingot. Solidification of the molten metal is achieved by direct application of water from the cooling manifold to the ingot shell.

The cooling manifold may direct the water against the ingot from above, from within or from below the inductor as exemplified in U.S. Pat. No. 3,646,988 to Getselev. In some prior art approaches the inductor is formed as part of the cooling manifold so that the cooling manifold supplies both coolant to solidify the casting and to cool the inductor as exemplified in U.S. Pat. Nos. 3,773,101 to Getselev and 4,004,631 to Goodrich et al.

The non-magnetic screen is utilized to properly shape the magnetic field for containing the molten metal as exemplified in U.S. Pat. No. 3,605,865 to Getselev. Another approach with respect to non-magnetic screens is exemplified as well in U.S. Pat. No. 3,985,179 to Goodrich et al. Similarly, a variety of inductor designs are set forth in the aforenoted patents.

While the above described patents disclose electromagnetic casting molds for casting a single strand or ingot at a time, the process can be applied to the casting of more than one strand or ingot simultaneously as exemplified in U.S. Pat. No. 3,702,155.

In addition to the aforenoted patents a further description of the electromagnetic casting process can be found by reference to the following articles: "Continuous Casting with Formation of Ingot by Electromagnetic Field", by P. P. Mochalov and Z. N. Getselev, Tsvetnye Met., August, 1970, 43, pp. 62–63; and "Casting in an Electromagnetic Field", by Z. N. Getselev, J. of Metals, October, 1971, pp. 38–59.

In the electromagnetic casting process the molten metal head is contained and held away from the mold walls by an electromagnetic pressure which counterbalances the hydrostatic pressure of the molten metal head. Thus the EM casting apparatus is designed by various approaches to induce the desired current levels in both the liquid metal and the hot solid metal beneath it at the solidification front which would result in desired containment of the liquid metal. As a result, the distribution of current is to a large extent dependent on the electrical resistivities of the liquid and hot solid metal or their ratio and the current frequency of the electromagnetic field generating means.

The problem arises however that at the start of the EM casting run there is no hot solid metal and the apparatus initially sees instead a surge of molten metal and a water cooled bottom block which is likely to be at or close to ambient temperature. In addition, the initial surge of molten metal fed to the EM casting apparatus involves not only hydrostatic forces tending to cause overflow but also dynamic forces attributable to the initial surge. In the absence of physical sidewalls associated with normal DC casting the problem becomes to prevent run out of the molten metal before the containment field is established, without having to make large initial upward adjustments in the inductor current amplitude.

The present invention overcomes the deficiencies described above and provides a simple effective means for controlling overflow of the bottom block during start up of an EM casting run without a requirement of an initial upward adjustment of the steady state electromagnetic field power parameters.

SUMMARY OF THE INVENTION

This invention relates to a process of electromagnetically casting a metal and in particular to a process and bottom block arrangement for start up of an EM casting run.

In accordance with one preferred embodiment of this invention an improved bottom block and start up process is disclosed wherein a bottom block is provided which is constructed of a material having an electrical resistivity closely matched to the resistivity of the metal to be cast to thereby electrically reproduce or mimic the conditions existing during steady state EM casting.

In accordance with another preferred embodiment a bottom block and process for using the block in an EM start up process is disclosed wherein a deep hollowed out central section in the top surface of the bottom block is utilized to control dynamic forces tending to cause molten metal run out.

Accordingly, it is an object of this invention to provide an improved process and apparatus for electromagnetic start up of an EM casting run.

It is a further object of this invention to provide a process and apparatus as above wherein advantageous containment conditions are provided at the start of an EM casting run.

These and other objects will become more apparent from the following description and drawings.

DETAILED DESCRIPTION OF PREFERRED EMBODIMENTS

Figure 1:
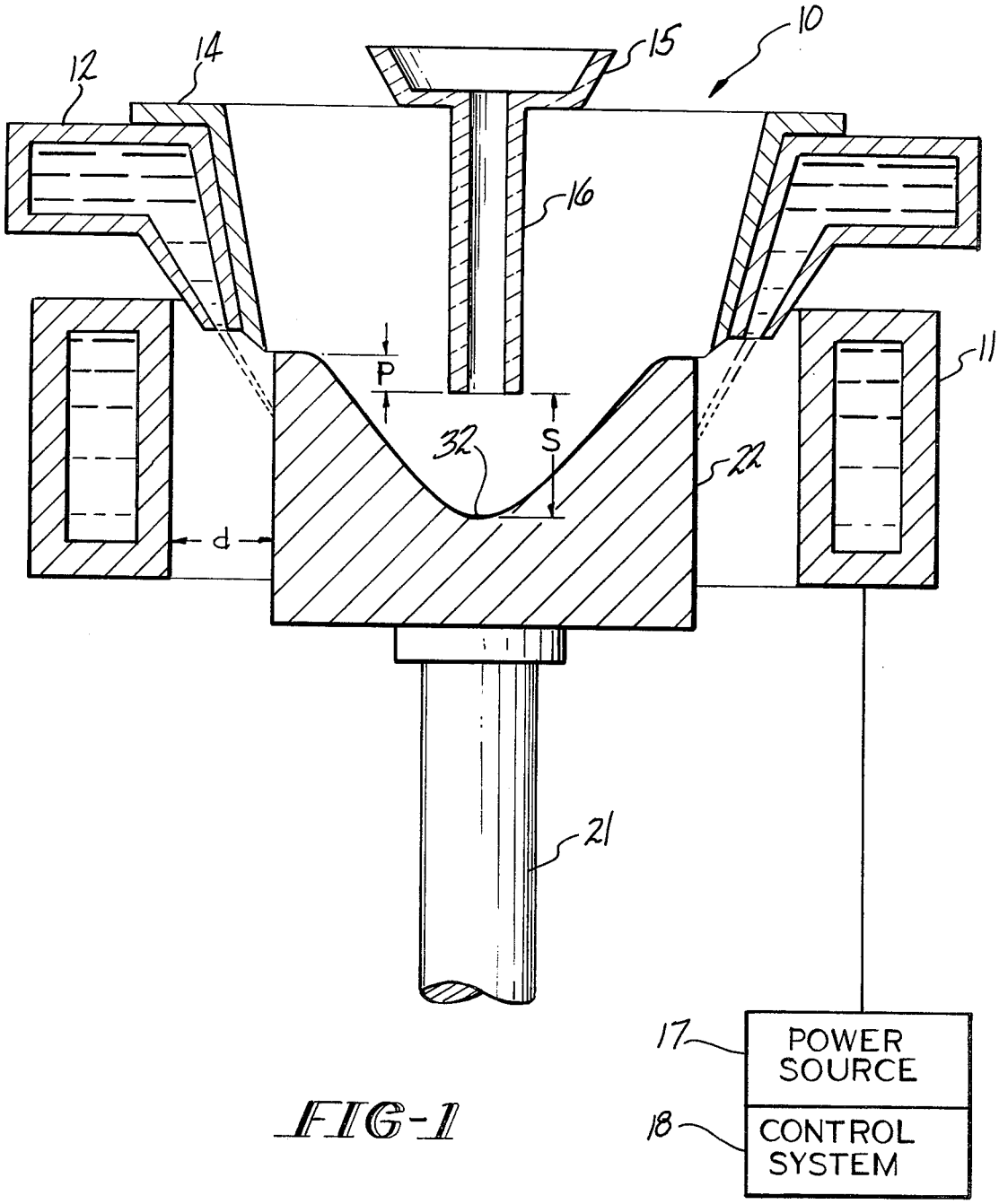
FIG. 1 is a schematic representation of an electromagnetic casting apparatus showing a bottom block in start up position prior to the start of an electromagnetic casting run in accordance with the present invention.

Referring now to FIG. 1 there is shown by way of example the electromagnetic casting apparatus of this invention.

The electromagnetic casting mold 10 is comprised of an inductor 11 which is water cooled; a cooling manifold 12 for applying cooling water to the peripheral surface 13 of the metal being cast C; and a non-magnetic screen 14. Molten metal is continuously introduced into the mold 10 during a casting run using a trough 15 and a down spout 16, with the initial surge of molten metal contacting bottom block 22 in its raised position (FIG. 1), and thereafter using conventional molten metal head control. The inductor 11 is excited by an alternating current from a power source 17 and control system 18. Such a control system is described in our copending application Ser. No. 905,889 filed May 15, 1978 and assigned to the assignee herein, which application is hereby incorporated by reference.

The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it so that it solidifies in a desired ingot cross section.

An air gap d exists during casting, between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot C cross section.

The purpose of the non-magnetic screen 14 is to fine tune and balance the magnetic pressure with the hydrostatic pressure of the molten metal head 19.

Referring to FIG. 1, the bottom block of this invention 22 is initially held in the magnetic containment zone of the mold 10 by ram 21 to allow the molten metal to be poured into the mold at the start of the casting run. The ram 21 and bottom block 22 are then uniformly withdrawn at a desired casting rate.

Figure 2:
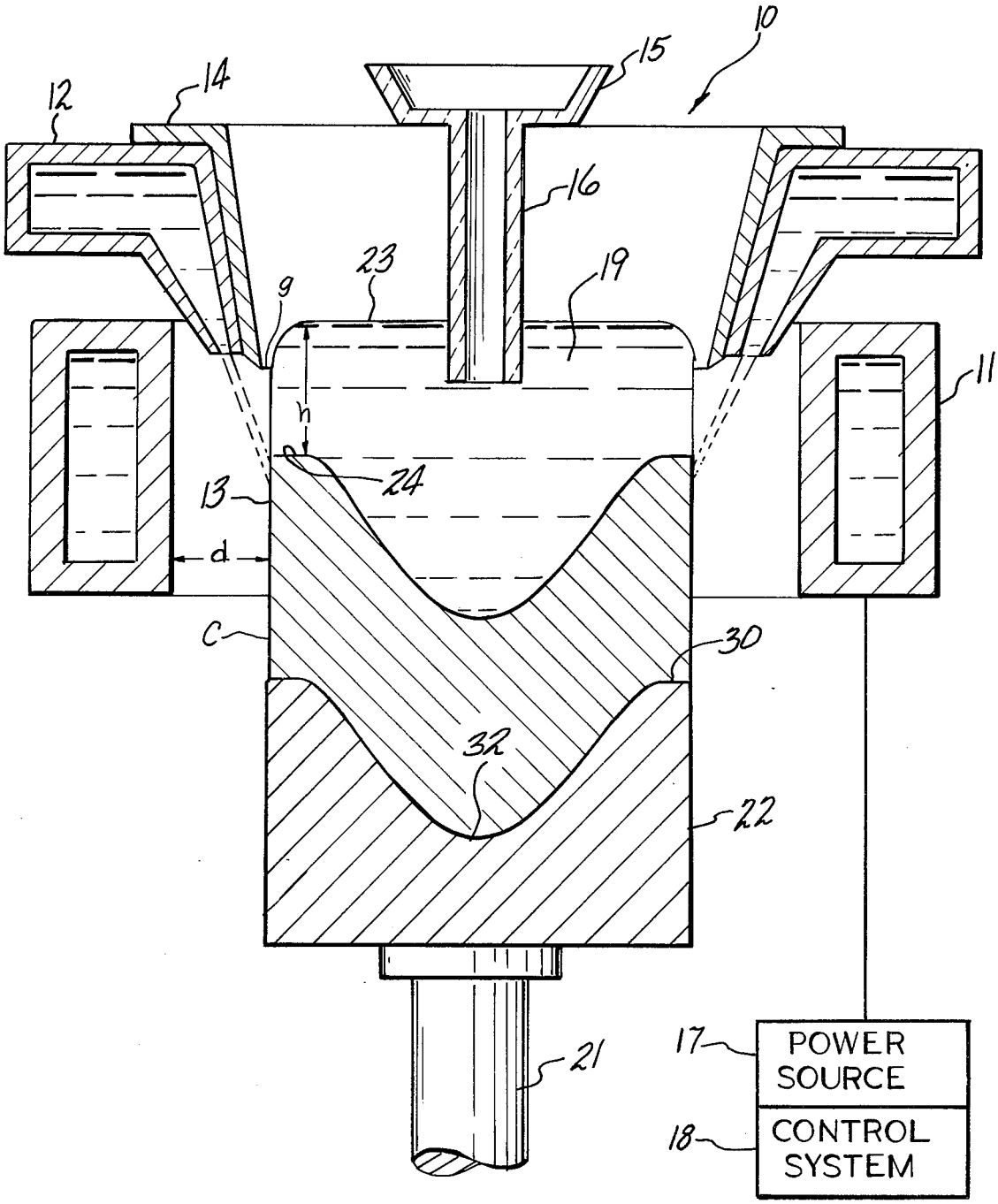
FIG. 2 is a schematic representation of an electromagnetic casting apparatus in the steady state of an electromagnetic casting run in accordance with the present invention.

Solidification of the molten metal which is electromagnetically contained in the mold 10 is achieved by direct application of water from the cooling manifold 12 to the ingot surface 13. In the embodiment which is shown in FIG. 2 the water is applied to the ingot surface 13 within the confines of the inductor 11. The water may be applied to the ingot surface 13 above, within or below the inductor 11 as desired.

If desired any of the prior art mold constructions or other known arrangements of the electromagnetic casting apparatus as described in the Background of the Invention could be employed.

The present invention is concerned with the obtaining of the most advantageous containment conditions at the start of the electromagnetic casting run when the bottom block is introduced into the inductor to support the initial surge of metal fed to the molding apparatus.

It has been found in accordance with this invention that two factors of bottom block construction greatly affect containment of the molten metal at start up. First, it has been found to be advantageous to electrically reproduce or mimic the conditions existing during steady state casting, especially as they relate to solid and liquid resistivities. Second, it has been discovered that the providing of a central hollowed out section in the top surface of the bottom block aids in reduction of the dynamic forces associated with the initial surge of molten metal at start up.

At start up there are two forces working to overcome the electromagnetic containment field, the hydrostatic force associated with the head h, and the dynamic force associated with the initial surge of molten metal, both of which combine tending to cause overflow of molten material at start up.

The bottom block and process of this invention accomplish well-defined and stable containment conditions at start up by assuring correct induced current distribution in the bottom block and molten metal at start up and by providing a suitable reservoir to overcome the dynamic forces tending to cause overflow of molten metal.

In accordance with this invention the bottom block material is selected such that the resistivity of the water cooled bottom block at or near ambient temperature conditions is closely matched to the resistivity of the metal being cast at a temperature of 0° to 100° F. below the latters solidus temperature. Thus, at start up, current is distributed in the molten metal and the bottom block so as to reproduce or mimic the current flow in the liquid metal and hot solid metal during steady state casting conditions.

In a preferred embodiment, it is desirable to select a bottom block material having a resistivity at ambient temperature such that the ratio of the resistivity of the metal being cast (at a temperature of 0° to 100° F. below its solidus temperature) to the resistivity of the bottom block is less than about 2:1, and most preferably less than about 1.5:1.

By way of example, a bottom block for casting copper alloy C51000 should be selected which has a resistivity closely matched to a range of 35–40 Microhm-cm. This is the resistivity range of alloy C51000 at temperatures close to the solidus temperature. Following the teachings of this invention one might select a bottom block comprised of copper alloy C71500. Alloy C71500 has a resistivity of 37.5 Microhm-cm at 68° F. which is closely matched to the resistivity of alloy C51000 at temperatures close to its solidus. Selection of alloy C71500 would thus result in inducing currents into the bottom block reproducing those which would be induced into the hot solid beneath the solidification front during steady state casting. This resultant distribution of current obtains the most advantageous containment conditions at start up without the requirement of making special adjustments in apparatus current parameters at start up.

By way of comparison, if one were to select a bottom block material of say for instance commercially pure ETP copper in casting alloy C51000, preferential current would be induced into the bottom block consequently starving containment forces in the liquid alloy C51000 thereby requiring proportionally larger initial current amplitudes. This is so because commercially pure ETP copper has a resistivity of about 1.7 Microhm-cm at 68° F., more than an order of magnitude lower than the resistivity of alloy C51000 at temperatures close to the solidus.

A second aspect of the invention lies in the fact that in electromagnetic casting, unlike DC casting, there is an absence of physical mold sidewalls to prevent run out of molten metal before establishment of a suitable containment field. By providing the bottom block with a central hollowed out section as shown in FIG. 2, smooth start up conditions are enhanced since the reservoir 32 formed by the hollowed out portion of the block tends to restrain the dynamic forces associated with the initial surge of molten metal into the casting apparatus. In addition, the hollowed out portion served to stabilize and hold the butt end of the ingot during the steady state casting portion of the process.

The eddy currents produced in the bottom block and the molten metal by the electromagnetic forming means decrease in intensity as one travels from the periphery toward the vertical axis of the bottom block. Therefore, in one preferred embodiment, the continuously curved reservoir contour approximates or parallels the solidification front in at least the periphery area of the bottom block while in the most preferred form of the invention, the entire continuously curved contour of the reservoir approximates or parallels the contour of the solidification front. Moreover, such a continuously curved contour, while serving to reproduce steady state conditions, also provides excellent directionality to the initial flow of molten metal at start up, thereby also tending to prevent run out.

In another preferred embodiment, when the bottom block is in its start up position as shown in FIG. 1, down spout 16 projects a distance p below the plane of the top surface 30 of the bottom block, while the end of down spout 16 remains a distance s from the bottom of reservoir 32. The preferred values of p and s are at least about ½ inch and at least about 1 inch respectively. Thus the overall depth of the reservoir should be at least about 1½ inches from the plane of the top surface of the block. Such an arrangement will minimize the dynamic forces tending to cause run out while allowing enough clearence between the spout 16 and the bottom of reservoir 32 to prevent freezing of the molten metal in the spout at start up.

It is apparent that there has been provided in accordance with this invention a bottom block for use in electromagnetic casting apparatus and a process for electromagnetic casting start up which fully satisfy the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a process for casting a metal by electromagnetically containing and forming molten metal into a desired shape, said electromagnetic containing and forming including the steps of pouring molten metal into a bottom block, providing an inductor for applying a magnetic field to said molten metal, and applying an alternating current to said inductor to generate said magnetic field, said inductor in operation being spaced from said molten metal by a gap extending from the surface of the molten metal to the opposing surface of the inductor, the improvement wherein said process further comprises:

closely matching the electrical resistivity of said bottom block to the electrical resistivity of the metal to be cast, whereby during start up advantageous containment of the initial surge of molten metal is accomplished.

2. A process as in claim 1 wherein said bottom block resistivity comprises its resistivity at ambient temperature conditions and said metal resistivity comprises its resistivity at a temperature within the range of 0° to 100° F. below the solidus temperature of said metal.

3. A process as in claim 1 including the step of providing said bottom block with a deeply hollowed out central section.

4. A process as in claim 3 wherein said pouring step is from a spout and said bottom block is brought into close proximity with the end portion of said spout during start up of the electromagnetic casting run.

5. A process as in claim 4 wherein the step of bringing said bottom block into close proximity is carried out such that the end of said spout projects into said deeply hollowed out central section.

6. A process as in claim 5 wherein the end of said spout projects into said hollowed out central section at least about ½ inch below the top surface plane of said bottom block.

7. A process as in claim 5 wherein the end of said spout is located at least about 1 inch from the bottom most point of said hollowed out central section.

8. A process as in claim 6 wherein the end of said spout is located at least about 1 inch from the bottom of said hollowed out central section.

9. A process as in claim 1 wherein said step of closely matching is carried out such that the ratio of the resistivity of said metal to the resistivity of said bottom block is less than about 2:1.

10. A process as in claim 2 wherein said step of closely matching is carried out such that the ratio of the resistivity of said metal to the resistivity of said bottom block is less than about 1.5:1.

11. A process as in claim 3 wherein said hollowed out central section is provided with a contour which approximates the contour of the steady state solidification front of said shape along at least a portion thereof.

12. In a process for casting a metal by electromagnetically containing and forming molten metal into a desired shape, said electromagnetic containing and forming including the steps of pouring molten metal from a spout into a bottom block, providing an inductor for applying a magnetic field to said molten metal and applying an alternating current to said inductor to generate said magnetic field, said inductor in operation being spaced from said molten metal by a gap extending from the surface of the molten metal to the opposing surface of the inductor, the improvement wherein said process further comprises:

providing a bottom block having a continuously curved deeply hollowed out central section in the top surface thereof, said hollowed out central section having a contour which approximates the contour of the steady state solidification front of said shape, whereby the initial surge of molten metal into the casting apparatus during start up can be restrained thereby preventing run out of the molten metal.

13. A process as in claim 12 wherein said bottom block is brought into close proximity with the end portion of said spout during start up of the electromagnetic casting run such that the end of said spout projects into said deeply hollowed out central section.

14. A process as in claim 13 wherein the end of said spout projects at least about ½ inch below the plane of the top surface of said bottom block.

15. A process as in claim 13 wherein the end of said spout is located at least about 1 inch from the bottom most point of said hollowed out central section.

16. A process as in claim 14 wherein the end of said spout is located at least about 1 inch from the bottom most point of said hollowed out central section.

* * * * *